US006199911B1

(12) United States Patent
Isherwood et al.

(10) Patent No.: US 6,199,911 B1
(45) Date of Patent: Mar. 13, 2001

(54) SECURITY ELEMENT FOR SECURITY PAPER

(75) Inventors: Roland Isherwood, Whitchurch; John Martin Haslop, Reading, both of (GB)

(73) Assignee: De la Rue International Limited, Hampshire (GB)

( * ) Notice: Subject to any disclaimer, the term of this patent is extended or adjusted under 35 U.S.C. 154(b) by 0 days.

(21) Appl. No.: 09/381,843

(22) PCT Filed: Mar. 31, 1998

(86) PCT No.: PCT/GB98/00954

§ 371 Date: Sep. 24, 1999

§ 102(e) Date: Sep. 24, 1999

(87) PCT Pub. No.: WO98/44199

PCT Pub. Date: Oct. 8, 1998

(30) Foreign Application Priority Data

Apr. 3, 1997 (GB) ..... 9706749

(51) Int. Cl.[7] ..... D21H 21/42; B42D 15/00; B41M 3/14

(52) U.S. Cl. ..... 283/83; 283/91; 283/114

(58) Field of Search ..... 283/91, 93, 114, 283/83

(56) References Cited

U.S. PATENT DOCUMENTS

| | | | | |
|---|---|---|---|---|
| 4,652,015 | * | 3/1987 | Crane | 283/91 |
| 4,761,205 | | 8/1988 | Crane | 162/103 |
| 4,941,687 | * | 7/1990 | Crane | 283/91 |
| 4,943,093 | * | 7/1990 | Melling et al. | 283/83 |
| 5,093,184 | * | 3/1992 | Edwards | 283/91 |
| 5,388,862 | * | 2/1995 | Edwards | 283/82 |
| 5,486,022 | * | 1/1996 | Crane | 283/91 |
| 5,573,639 | * | 11/1996 | Schmitz et al. | 428/916 |

FOREIGN PATENT DOCUMENTS

| | | |
|---|---|---|
| 0059056 | 9/1982 | (EP) . |
| 0070172 | 1/1983 | (EP) . |
| 0229645 | 7/1987 | (EP) . |
| 0319157 | 6/1989 | (EP) . |
| 0400902 | 12/1990 | (EP) . |
| 0659587 | 6/1995 | (EP) . |
| 0659936 | 6/1995 | (EP) . |
| 1552853 | 9/1979 | (GB) . |
| 1604463 | 12/1981 | (GB) . |
| 9420683 | 9/1994 | (WO) . |

* cited by examiner

*Primary Examiner*—Cathy Lam
(74) *Attorney, Agent, or Firm*—Dykema Gossett PLLC

(57) ABSTRACT

The invention relates to a security element for security paper for banknotes and the like having both aesthetic and anti-counterfeitable qualities. The invention comprises a security element for wholly or partially embedding in security paper comprising an elongate strip of a light transmitting polymeric substrate. The substrate bears a reflective metallic layer on at least one surface thereof in the form of a design. The design comprises at least one repeating geometric pattern of which one of more of the frequency, instantaneous amplitude and/or maximum amplitude of the pattern varies along the length of the element and design having at least one non-linear boundary.

70 Claims, 1 Drawing Sheet

FIG. 1.
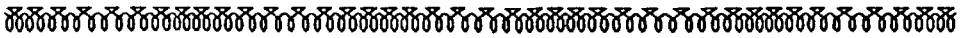
FIG. 2.
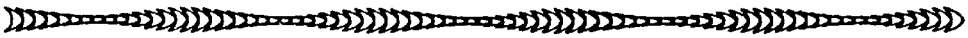
FIG. 3.
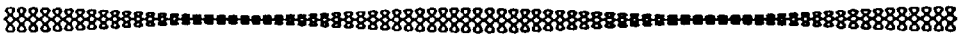
FIG. 4.
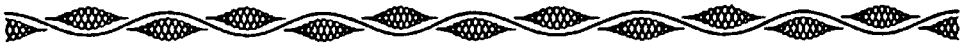
FIG. 5.
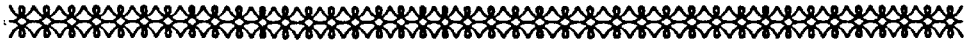
FIG. 6.
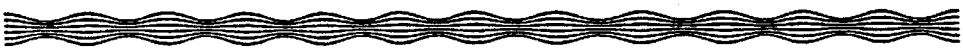
FIG. 7.
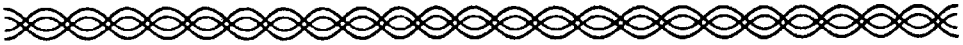
FIG. 8.
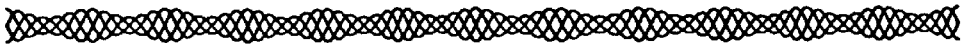
FIG. 9.
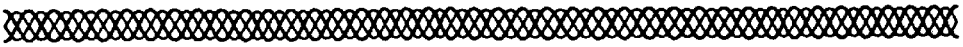
FIG. 10.
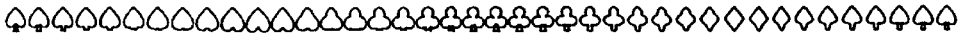
FIG. 1a.
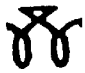
FIG. 4a.
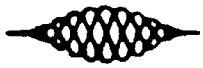
FIG. 5a.
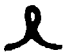
FIG. 2a.
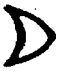
FIG. 5b.
FIG. 4b.
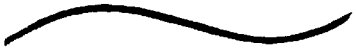
FIG. 3a.
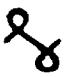

SECURITY ELEMENT FOR SECURITY PAPER

The invention relates to a security element for security paper for banknotes and the like having both aesthetic and anti-counterfeitable qualities.

It is widely known to use in banknotes and other security documents security elements, such as security threads or strips, which are made from a transparent film provided with a continuous reflective metal layer, such as aluminium, which is vacuum deposited on, for example, polyester film. Banknotes made from such paper have been in general circulation in many countries for many years. When the security threads are embedded in the security paper and the paper is subsequently printed to provide the security documents, the threads cannot be readily discerned in reflective light but is immediately transparent as a dark image when the document is viewed in transmitted light.

In recent times, in order to enhance the security of security documents, especially banknotes, against modern counterfeiting techniques making use of the sophisticated colour separation, printing and colour photocopier technology, it has become common to use a security thread comprising a thin layer of aluminium on a plastic support which is exposed on one side of the sheet at intervals along the length of the element, the region of exposure being referred to as a window. GB-A-1,552,853 and GB-A-1,604,463 disclose banknotes containing such windows. Paper for use in producing such banknotes can be made using the method disclosed in our European Patent Specification EP-A0,059,056. The widespread use of banknotes having security threads exposed in windows along the length of the element has resulted in enhanced security. A banknote of this type provides added security against counterfeiters as, when viewed in transmitted light, the strip is seen as a dark line, and, when viewed in reflected light on the appropriate side, the bright shiny aluminium portions which are exposed at the windows are readily visible. However, there is a need for even greater security by the use of more sophisticated devices in order to render the task of a would be counterfeiter more difficult as the reflected light appearance of the exposed aluminium portions of a security device can be simulated by modern materials and techniques, for example by the use of hot foil stamping.

More recent developments in this field include security paper with a security element as described in U.S. Pat No. 4,652,015 in which a resist and etch technique is used to selectively demetalise regions of a vacuum deposited aluminium layer on a polyester film thereby leaving security indicia comprising metal characters on the plastic strip. The strip is wholly embedded in the paper and the metal characters are undetectable to the unaided eye and in reflective illumination whilst only becoming legible in transmitted light. However, this type of thread is unsuitable for windowed applications. Because the characters are discrete and separated, the resulting look in windows is confusing and uneven.

A further improvement described in our patent specification EP-A-0,319,157 which describes the use of a partially metallised film having metal-free portions of between 10% and 50% of the area of the device, the metal-free portions along the length of the device providing a repeating pattern, design or indicia. The metal layer, however, retains a continuous metal path along its length. Banknotes formed from security threads as described therein provide excellent security and a public security feature in which the threads are eminently "readable" by the public when viewing the threads in transmitted light without the aid of a lens or other viewing accessory. In transmitted light the threads appear as black strips which very clearly stand out against their surroundings. In the embedded version, the threads are almost invisible when viewed with reflected light, although obviously the threads can be used in windowed paper also. In the windowed version, the thread is seen in reflected light as silver blocks in the windows surrounding the metal free areas.

Whilst this type of thread produces an easily recognisable effect suitable for windows or embedding, the straight edges of the negative block can be mimicked by blocking techniques.

In EP-A-0659936 a security thread is described which consists of a light transmitting plastic film with a coating which is at least partly opaque and in which the thread comprises information in the form of visually and/or machine readable characters or pattern which extend from the opaque region into an adjacent light transmitting region. This has the advantage that the visual impression can only be imitated by means of very complex techniques.

EP-A-0659587 describes a security thread which again consists of a light transmitting plastic film with a coating which is at least partly opaque. The coating has light transmitting regions in the form of visually and/or machine readable characters or patterns, which form a first type of information. A second type of information in the form of visually and/or machine readable characters or patterns is additionally disposed on the plastic film and differs from the first type of information in terms of size and/or visual impression. In the examples described in the specification there is a combination of a negative inscription, which cannot be copied because of the reflective light/transmitted light effect, with a further type of information which is particularly easy to distinguish by reflective light. Alternatively the protective effect utilises the comparison between large easily legible negative inscription and a small negative inscription which is visually difficult to resolve on a transparent plastic thread.

It is an object of the present invention to further enhance the security of security elements such as threads.

According to the invention there is therefore provided a security element for wholly or partially embedding in security paper comprising an elongate strip of a light transmitting polymeric substrate, said substrate bearing a reflective metallic layer on at least one surface thereof in the form of a design, characterised in that said design comprises at least one substantially lineal repeating pattern consisting of one or more lines or shapes formed by one or more lines, of which pattern one or more of the frequency, instantaneous amplitude and/or maximum amplitude of the pattern varies along the length of the element, the and/or at least one other geometric pattern also providing a continuous metal path along the length of the element, said design having at least one non-linear boundary.

The use of a repeating geometric pattern, as opposed to printed messages, has the advantage that it is more likely to be recognised on a narrow thread than alpha-numeric characters which become less legible as they get smaller. A repeating pattern is aesthetically more attractive than the designs delineated by straight edges which are most commonly used currently and are described in EP-A-0319157.

Alternatively a security element for wholly or partially embedding in security paper comprising an elongate strip of a light transmitting polymeric substrate, said substrate bearing a reflective metallic layer on at least one surface thereof in the form of a design, characterised in that said design comprises at least one repeating pattern consisting of one or more lines or shapes formed by one or more lines, the pattern comprising a sequence of adjacent discrete elements each incrementally different from the preceding and following elements.

Preferably at least one of the repeating patterns has a maximum width of the reflective metal layer in the transverse direction of 0.8 mm and more preferably of 0.5 mm.

In a preferred embodiment of the invention, the width of the security element is greater than or equal to 2 mm thus allowing integration of complex surface patterns into the paper substrate.

Preferably the design has at least one continuous metal path. This continuous metal path advantageously provides an electrically conductive path extending along the length of the element so that the element may be detected using conventional metal thread detection equipment on, for example, a used note sorting machine. The property of such threads being detectable with conventional metal thread detection equipment is a valuable property in helping to eliminate counterfeiting. Furthermore, by provision of a suitable detector, the distribution of metal within the security element may be determined by electrical or other means and compared to a reference pattern to provide a further technique for the authentification of a genuine document containing the element.

In a preferred embodiment of the invention the design is formed from metallic lines in which the widths of at least some of the lines lie in the range 0.05 mm to 0.15 mm inclusive. Thus the security element is designed so that it is exceptionally difficult, if not impossible, for a counterfeiter to mimic the presence of a thread by foil blocking onto paper, one of the traditional methods of counterfeiting threads, without having to resort to reproducing the thread and embedding it which is not commercially viable for them. The invention therefore provides enhanced anti-counterfeitability.

The width of at least some of the lines preferably lie in the range of 0.05 mm to 0.10 mm.

The preferred embodiment of the invention of the security element is at least partially embedded in the article. Preferably portions of the security element are exposed at the surface of the article at spaced intervals along the length of the security element at windows in the article.

Many of the prior art security threads are not suitable for use as windowed threads especially those in which the indicia on the element are discrete and separated. This has a very confusing and uneven effect in windows and looks very poor. In this embodiment of the invention, on the other hand, the design is such that it has an aesthetic appeal when viewed in the windows and as it is easily recognisable in transmitted and reflected light can be seen and distinguished clearly.

In a preferred embodiment of the invention the window length is greater or equal to 5 mm.

Preferably the repeating pattern is in register with the windows in the longitudinal direction of a security element so that an identical portion of the design is seen in each window. This makes it harder for counterfeiters as such registration is very difficult to imitate by foil blocking techniques.

The security article is preferably provided with printing on at least one side thereof to identify the article, said printing including a pattern corresponding to at least one of the repeating metallic patterns of the security element. This feature greatly enhances the aesthetic appeal of the article as a whole, whilst taking advantage of and enhancing the anti-counterfeiting feature of the security element itself.

In the security element of the present invention, a transparent colourless polyester film, which is flexible and water-impermeable, is provided with a layer of metal on at least one side thereof. One suitable method is the vacuum deposition of aluminium or another suitable metal. The metallised film is partially demetallised by a known technique to provide a design as described in more detail below. However, high reflectivity metallic inks or non-metallic opaque inks may be deposited by a printing technique to provide the design. The film is slit to form individual security elements, or threads, having a width of at least 0.5 mm and preferably at least 2 mm. The security element is inserted into the paper, e.g. on a cylinder mould paper machine so that it is either wholly or partially embedded within the paper fibres. The method by which the security element is embedded can either be by the method described in EP-A-0059056 or EP-A-0229654 or EP-A-0070172 or WO94/20683 or any other suitable method. If the method of EP-A-0070172 is used, it should be noted that the security element requires permeable and impermeable areas.

Whilst the security element can be used in wholly embedded or windowed form, the latter is preferred as the design is then easily recognisable in both reflected and transmitted light, rather than just transmitted light as in the wholly embedded form.

The windows in the surface of the paper may thus be substantially the same width as the security element or narrower as required in some of the aforementioned specifications.

The repeating pattern(s) may be in register with the windows in the machine direction, so that an identical portion of the design is seen in each window. This requires a registration mechanism to be fitted to the thread insertion equipment at the point of incorporation of the element into the paper at the wet end of the paper making machine.

The finished security paper is printed on one or both sides to identify the article or document formed from the paper. This printing preferably includes one or more of the repeating patterns of the design on the security element itself or indeed the whole design. The security element may have a tinted coat to match the colour of the paper or the printing itself to enhance the visual effect of the metallic pattern.

Alternatively, the polyester substrate may, instead of being colourless and transparent, be coloured with a dye to match the printing.

FIGS. 1–10 illustrate various embodiments of designs for use in security elements according to this invention so as to provide security enhancing features, and FIGS. 1*a*, 2*a*, 3*a*, 4*a*, 4*b*, 5*a*, and 5*b* show details of the design of FIGS. 1, 2, 3, 4, and 5, respectively. The designs are made up of one or more varying geometric patterns, the whole combination of which constitutes the design. Each of the designs has at least one non-linear boundary i.e. one of the extreme edges of the overall design.

In FIG. 1 the design has a single repeating geometric pattern the repeating element of which is shown in FIG. 1*a*, the pattern being created from a single metallic line providing a continuous metal path. The frequency of this pattern varies along the length of the thread.

In FIG. 2, the design has a single repeating pattern made up from the repeating element shown in FIG. 2*a*. Each element of the pattern touches the adjacent elements, so providing a continuous metal path along the length of the design. In this design the maximum amplitude of the pattern varies along the length of the security thread, i.e the maximum transverse width of each element of the pattern varies from element to element.

In the design of FIG. 3, there are two repeating geometric patterns each created from a single fine line having repeating elements corresponding to FIG. 3*a*, the patterns being offset from each other and each providing a continuous metal path. In this design the maximum amplitude of each pattern varies along the length of the thread.

In FIG. 4 the design has two different repeating geometric patterns of which the periodic curve of FIG. 4*b* provides a first repeating geometric pattern created from a fine metallic line of which the instantaneous amplitude, i.e. the perpendicular distance of each point on the curve from the central axis, varies along the length of the thread. In this design there is a second repeating geometric pattern, the repeating elements of which is shown in FIG. 4*a*, each element being discrete. The transverse width of each discrete element is preferably 0.8 mm or less, and most preferably 0.5 mm. A continuous metal path is provided along the length of the thread by the first pattern.

In FIG. 5 there are four repeating geometric patterns, each providing a continuous fine metal path. Two of the patterns are created from the repeating element of FIG. 5*a* and two from that of FIG. 5*b*. The two identical patterns are inverted with respect to each other about a central axis. The instantaneous amplitudes of each pattern vary along the length of the thread.

In FIG. 6 there are six discrete repeating geometric patterns each providing a continuous metal path. At least four of the patterns are periodic curves of which the instantaneous amplitudes vary along the length of the thread. The central two patterns may be straight lines, or may also be periodic curves.

In FIG. 7 there are four repeating geometric patterns each of which comprises a periodic curve, the instantaneous amplitudes of which vary along the length of the thread.

In FIG. 8 there are four repeating patterns, each comprising a periodic curve of which the maximum amplitude of the curves varies along the length of the thread. Each of the patterns is identical but offset relative to each adjacent pattern along the longitudinal axis.

In FIG. 9 there are four repeating patterns, the maximum amplitude of which is constant, but of which the instantaneous amplitudes of each pattern vary along the length of the thread.

In FIG. 10 the repeating pattern comprises a sequence of adjacent, but not touching, discrete elements in which each element is incrementally different from the element preceding it and the one following it. Thus the repeating element of each pattern comprises the whole progression from, in this example, spades to hearts to clubs to diamonds and back to spades.

What is claimed is:

1. A security element for wholly or partially embedding in security paper comprising an elongate strip of a light transmitting polymeric substrate, said substrate bearing a reflective metallic layer on at least one surface thereof in the form of a design, characterised in that said design comprises at least one repeating pattern consisting of one or more lines or shapes formed by one or more lines, the pattern comprising a sequence of adjacent discrete elements each incrementally different from the preceding and following elements.

2. A security element as claimed in claim 1 in which the repeating pattern has a maximum width in the transverse direction of 0.8 mm.

3. A security element as claimed in claim 2 in which the width in the transverse direction of the repeating pattern is 0.5 mm.

4. A security element as claimed in claim 1, in which a width of the security element is greater than or equal to 2.0 mm.

5. A security element as claimed in claim 1, in which the design has at least one continuous metal path.

6. A security element as claimed in claim 1, in which the design is formed from metallic lines in which widths of at least some of the lines lie in the range of 0.05 mm to 0.15 mm inclusive.

7. A security element as claimed in claim 6 in which the widths of at least some of the lines lie in the range 0.05 mm to 0.10 mm.

8. A security element as claimed in claims 1, in which the substrate is colourless.

9. A security element as claimed in claim 1, in which the substrate is coloured.

10. A security element as claimed in claim 1, in which the element has a translucent coloured coat.

11. A security element for wholly or partially embedding in security paper comprising an elongate strip of a light transmitting polymeric substrate, said substrate bearing a reflective metallic layer on at least one surface thereof in the form of a design, wherein said design comprises at least one substantially continuous linearly repeating non-alphanumeric geometric pattern along the length of the security element formed from a plurality of fine lines, in which the instantaneous amplitude of the pattern varies along a length of the element, in that the at least one geometric pattern also provides a continuous metal path along the length of the element, and in that said pattern has no linear boundaries.

12. A security element as claimed in claim 11 in which the repeating pattern has a maximum width in a transverse direction of 0.8 mm.

13. A security element as claimed in claim 11 in which a width in the transverse direction of the repeating pattern is 0.5 mm.

14. A security element as claimed in claim 11 in which a width of the security element is greater than or equal to 2.0 mm.

15. A security element as claimed in claim 11 in which the design is formed from fine metallic lines in which widths of at least some of the lines lie in the range 0.05 mm to 0.15 mm inclusive.

16. A security element as claimed in claim 15 in which the widths of at least some of the lines lie in the range 0.05 mm to 0.10 mm.

17. A security element as claimed in claim 11 in which the substrate is colourless.

18. A security element as claimed in claim 11 in which the substrate is coloured.

19. A security element as claimed in claim 11 in which the element has a translucent coloured coat.

20. A security article including security paper comprising at least one elongate security element as claimed in claim 11 at least partially embedded in security paper.

21. A security article as claimed in claim 20 wholly embedded in security paper.

22. A security article as claimed in claim 20 in which portions of the security element are exposed at the surface of the article at spaced intervals along the length of the security element at windows in the article.

23. A security article as claimed in claim 20 wherein the window length is greater or equal to 5.0 mm.

24. A security article as claimed in claim 20 in which the repeating geometic pattern on the security element is in register with the windows in the longitudinal direction of the security element so that an identical portion of the design is seen in each window.

25. A security article as claimed in claim 20 in which the substrate is coloured or has a coloured coating which matches the colour of the paper in which it is embedded.

26. A security article as claimed in claim 20 in which the element is coloured or has a coloured coating which matches the colour of the paper in which it is embedded.

27. A security article, especially a banknote, as claimed in claim 20, said article being provided with printing on at least one side thereof to identify the article, said printing including a pattern corresponding to at least one of the repeating metallic patterns of the security element.

28. A security element as claimed in claim 20 in which the substrate or element is coloured or coated with a coloured coating which matches the colour of the printing.

29. A security element for wholly or partially embedding in security paper comprising an elongate strip of a light transmitting polymeric substrate, said substrate bearing a reflective metallic layer on at least one surface thereof in the form of a design, wherein said design comprises at least one substantially continuous linearly repeating non-alphanumeric geometric pattern along the length of a security element formed from a plurality of fine lines, in which the frequency of the pattern varies along the length of the element, in that the at least one geometric pattern also provides a continuous metal path along the length of the element, and in that said pattern has no linear boundaries.

30. A security element as claimed in claim 29 in which the repeating pattern has a maximum width in a transverse direction of 0.8 mm.

31. A security element as claimed in claim 29 in which the width in a transverse direction of the repeating pattern is 0.5 mm.

32. A security element as claimed in claim 29 in which the width of the security element is greater than or equal to 2.0 mm.

33. A security element as claimed in claim 29 in which a design is formed from fine metallic lines in which the widths of at least some of the lines lie in the range 0.05 mm to 0.15 mm inclusive.

34. A security element as claimed in claim 33 in which the widths of at least some of the lines lie in the range 0.05 mm to 0.10 mm.

35. A security element as claimed in claim 29 in which the substrate is colourless.

36. A security element as claimed in claim 29 in which the substrate is coloured.

37. A security element as claimed in claim 29 in which the element has a translucent coloured coat.

38. A security article including security paper comprising at least one elongate security element as claimed in claim 29 at least partially embedded in security paper.

39. A security article as claimed in claim 38 wholly embedded in security paper.

40. A security article as claimed in claim 38 in which portions of the security element are exposed at the surface of the article at spaced intervals along the length of the security element at windows in the article.

41. A security article as claimed in claim 38 wherein the window length is greater or equal to 5.0 mm.

42. A security article as claimed in claim 38 in which the repeating geometic pattern on the security element is in register with the windows in the longitudinal direction of the security element so that an identical portion of the design is seen in each window.

43. A security article as claimed in claim 37 in which the substrate is coloured or has a coloured coating which matches the colour of the paper in which it is embedded.

44. A security article as claimed in claim 37 in which the element is coloured or has a coloured coating which matches the colour of the paper in which it is embedded.

45. A security article, especially a banknote, as claimed in claim 38, said article being provided with printing on at least one side thereof to identify the article, said printing including a pattern corresponding to at least one of the repeating metallic patterns of the security element.

46. A security element for wholly or partially embedding in security paper comprising an elongate strip of a light transmitting polymeric substrate, said substrate bearing a reflective metallic layer on at least one surface thereof in the form of a design, wherein said design comprises at least one substantially continuous linearly repeating non-alphanumeric geometric pattern along a length of the security element formed from a plurality of fine lines, in which the maximum amplitude of the pattern varies along the length of the element, in that the at least one geometric pattern also provides a continuous metal path along the length of the element, and in that said pattern has no linear boundaries.

47. A security element as claimed in claim 46 in which the repeating pattern has a maximum width in a transverse direction of 0.8 mm.

48. A security element as claimed in claim 46 in which the width in a transverse direction of the repeating pattern is 0.5 mm.

49. A security element as claimed in claim 46 in which a width of the security element is greater than or equal to 2.0 mm.

50. A security element as claimed in claim 46 in which the design is formed from fine metallic lines in which widths of at least some of the lines lie in the range 0.05 mm to 0.15 mm inclusive.

51. A security element as claimed in claim 46 in which widths of at least some of the lines lie in the range 0.05 mm to 0.10 mm.

52. A security element as claimed in claim 46 in which the substrate is colourless.

53. A security element as claimed in claim 46 in which the substrate is coloured.

54. A security element as claimed in claim 46 in which the element has a translucent coloured coat.

55. A security article including security paper comprising at least one elongate security element as claimed in claim 46 at least partially embedded in security paper.

56. A security article as claimed in claim 55 wholly embedded in security paper.

57. A security article as claimed in claim 55 in which portions of the security element are exposed at the surface of the article at spaced intervals along the length of the security element at windows in the article.

58. A security article as claimed in claim 55 wherein the window length is greater or equal to 5.0 mm.

59. A security article as claimed in claim 55 in which the repeating geometric pattern on the security element is in register with the windows in the longitudinal direction of the security element so that an identical portion of the design is seen in each window.

60. A security article as claimed in claim 55 in which the substrate is coloured or has a coloured coating which matches the colour of the paper in which it is embedded.

61. A security article as claimed in claim 55 in which the element is coloured or has a coloured coating which matches the colour of the paper in which it is embedded.

62. A security article, especially a banknote, as claimed in claim 55 said article being provided with printing on at least one side thereof to identify the article, said printing including a pattern corresponding to at least one of the repeating metallic patterns of the security element.

63. A security article including security paper comprising at least one elongate security element as claimed in claim 1 at least partially embedded in security paper.

64. A security article as claimed in claim 1 wholly embedded in security paper.

65. A security article as claimed in claim 1 in which portions of the security element are exposed at the surface of the article at spaced intervals along the length of the security element at windows in the article.

66. A security article as claimed in claim 1 wherein the window length is greater or equal to 5.0 mm.

67. A security article as claimed in claim 1 in which the repeating geometric pattern on the security element is in register with the windows in the longitudinal direction of the security element so that an identical portion of the design is seen in each window.

68. A security article as claimed in claim 1 in which the substrate is coloured or has a coloured coating which matches the colour of the paper in which it is embedded.

69. A security article as claimed in claim 1 in which the element is coloured or has a coloured coating which matches the colour of the paper in which it is embedded.

70. A security article, especially a banknote, as claimed in claim 1 said article being provided with printing on at least one side thereof to identify the article, said printing including a pattern corresponding to at least one of the repeating metallic patterns of the security element.

* * * * *